US008960429B1

(12) United States Patent
Crockett

(10) Patent No.: US 8,960,429 B1
(45) Date of Patent: Feb. 24, 2015

(54) CASE FOR A TROWEL

(71) Applicant: Charles W. Crockett, Louisville, KY (US)

(72) Inventor: Charles W. Crockett, Louisville, KY (US)

( * ) Notice: Subject to any disclaimer, the term of this patent is extended or adjusted under 35 U.S.C. 154(b) by 0 days.

(21) Appl. No.: 14/087,644

(22) Filed: Nov. 22, 2013

Related U.S. Application Data

(60) Provisional application No. 61/736,177, filed on Dec. 12, 2012.

(51) Int. Cl.
*A45C 11/26* (2006.01)
*B25H 3/00* (2006.01)

(52) U.S. Cl.
CPC ..... *B25H 3/006* (2013.01)
USPC ..... 206/349

(58) Field of Classification Search
USPC ..... 206/317, 349, 38, 352; 15/235.4, 15/257.06
See application file for complete search history.

(56) References Cited

U.S. PATENT DOCUMENTS

| | | | | |
|---|---|---|---|---|
| 2,952,028 | A * | 9/1960 | Robbins | 15/235.4 |
| 4,307,825 | A * | 12/1981 | Pattermann | 224/231 |
| 7,017,739 | B2 * | 3/2006 | Barham et al. | 206/349 |
| 7,036,182 | B2 * | 5/2006 | Bukovitz et al. | 15/257.06 |
| 7,137,168 | B2 * | 11/2006 | Mann | 15/257.06 |
| 8,418,309 | B1 * | 4/2013 | Williams | 15/257.06 |
| 2003/0188987 | A1 * | 10/2003 | Welsh, Jr. | 206/521 |
| 2003/0226776 | A1 * | 12/2003 | Stamm | 206/349 |

* cited by examiner

*Primary Examiner* — Anthony Stashick
*Assistant Examiner* — Jennifer N Zettl
(74) *Attorney, Agent, or Firm* — Camoriano and Associates

(57) ABSTRACT

A case for holding a trowel which allows for safely and securely holding the trowel, protecting the user from sharp edges of the trowel, while conveniently presenting the trowel for ease of removal from the case. The case has an open configuration to allow for easy rinsing of the case itself and of the trowel when the trowel is sheathed inside the case.

4 Claims, 11 Drawing Sheets

CASE FOR A TROWEL

This application claims priority from U.S. Provisional Application Ser. No. 61/736,177 filed Dec. 12, 2012.

BACKGROUND

This invention relates to trowels. More specifically, it relates to a case for housing a trowel which is easy to use, makes the trowel easier to carry and protects the user from the sharp edges of the trowel.

Trowels generally are used for smoothing or otherwise moving around small amounts of viscous material, such as fresh concrete, mortar, drywall mud, and other similar materials. Typically, a worker on a construction job will use more than one trowel, carrying another trowel in his rear pocket by sticking the handle of the trowel into the pocket. This leaves all the sharp edges of the trowel blade out in the open, where they can be damaged or can cut someone, similar to a knife cut. It is desirable to have a case that is lightweight, takes up little space, is easy to use and can securely and releasably hold a trowel in a safe manner, whether for transportation or on the job.

DETAILED DESCRIPTION

Figure 6:
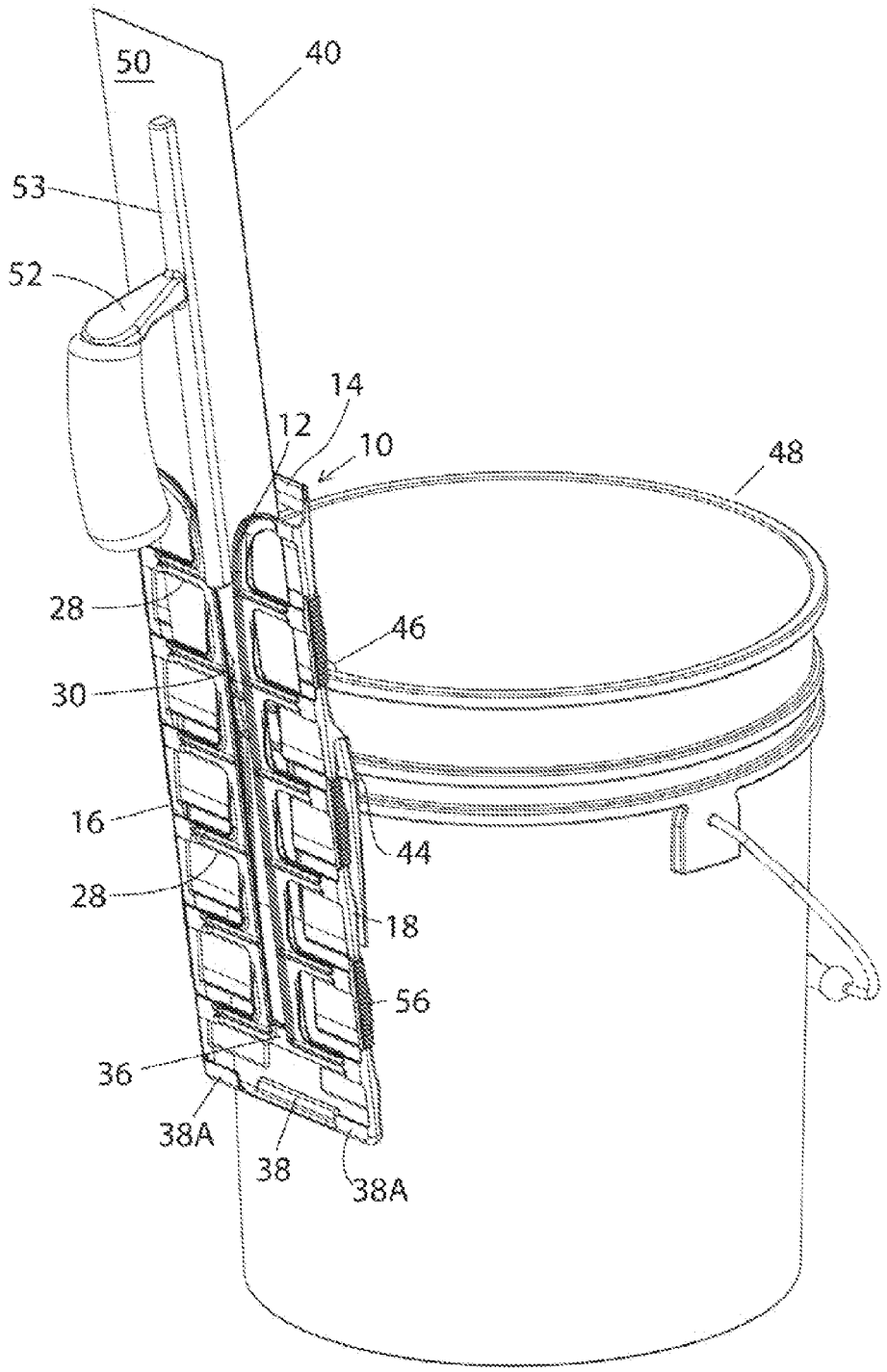
FIG. 6 is a perspective view of the case of FIG. 1, installed on the outside of a bucket and with a trowel in the process of being inserted into the case.

FIGS. 1-8 show one embodiment of a case 10 for a trowel 40 (See FIG. 6). The case 10 protects the user from the sharp edges of the trowel 40 while still being largely open, making it easy to rinse off the trowel 40 and the case 10 to remove mortar, mud, or other material that may be adhering to the trowel 40.

Figure 1:
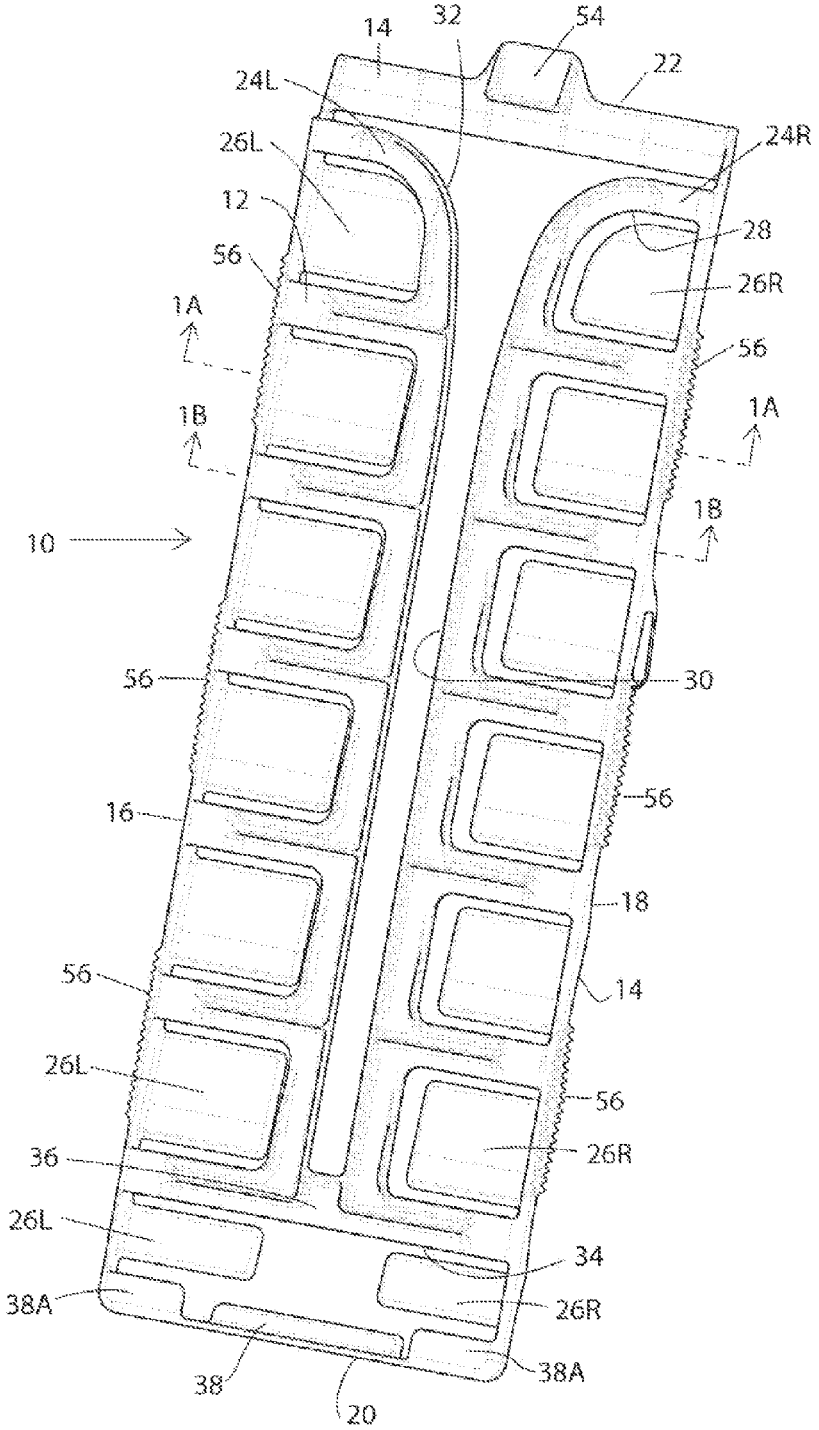
FIG. 1 is a front perspective view of a case for a trowel.
Figure 2:
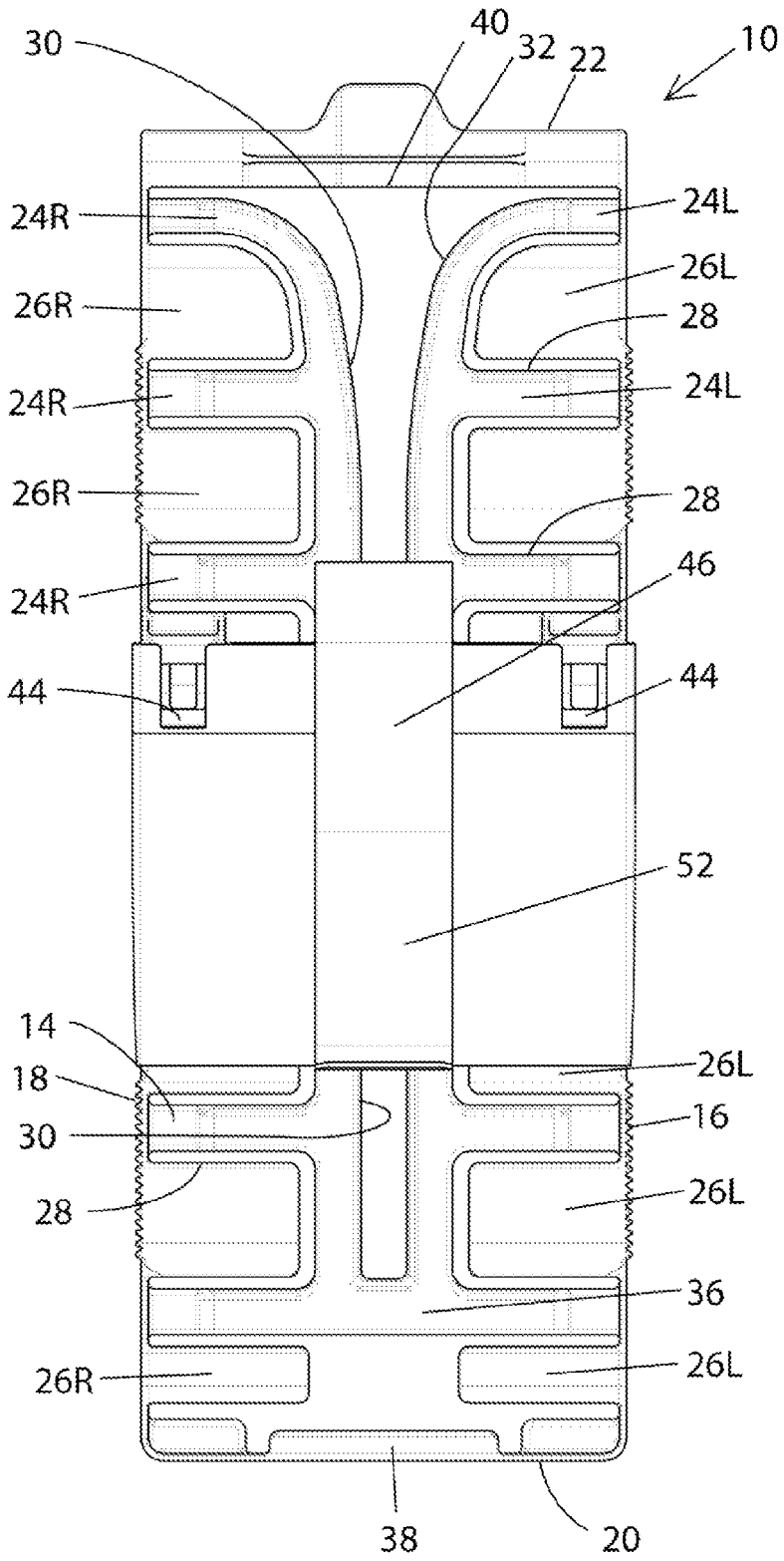
FIG. 2 is a rear view of the case of FIG. 1.
Figure 4:
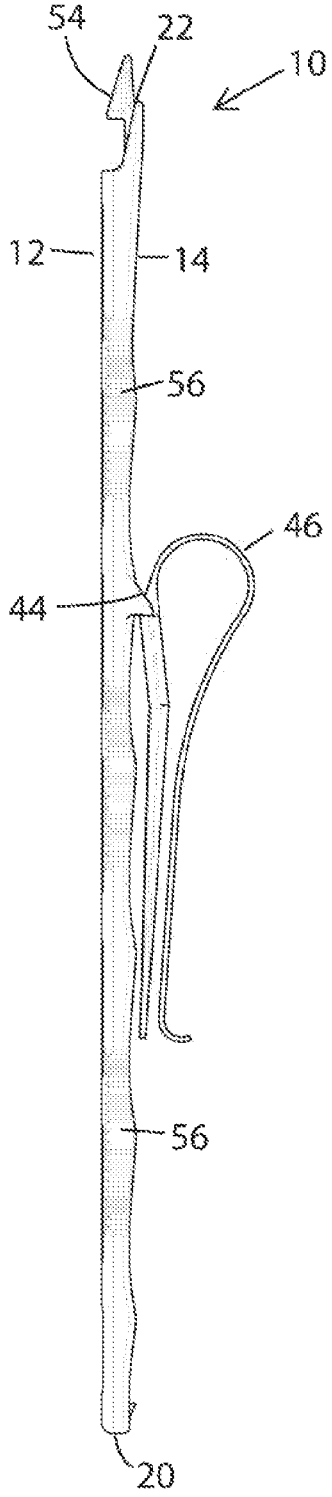
FIG. 4 is side view of the case of FIG. 2.
Figure 5:
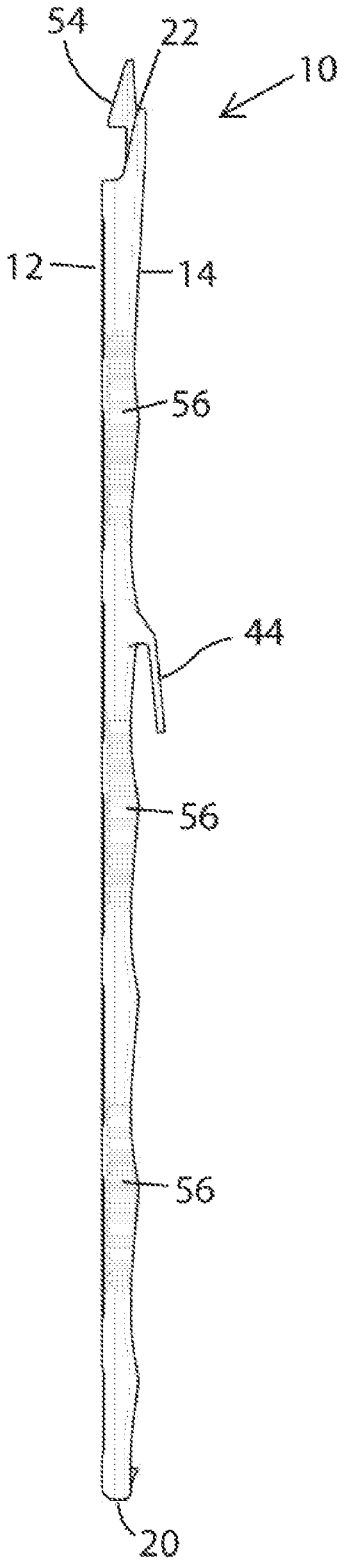
FIG. 5 is side view of the case of FIG. 3.

Referring to FIGS. 1, 2, and 4, the case 10 is a substantially two-dimensional rectangular sleeve having a flat, planar front wall 12, a flat, planar rear wall 14, left and right side edges 16, 18, a bottom edge 20, and a top edge 22. The front and rear walls 12, 14 are made up of a plurality of front retainers 24, and rear retainers 26 respectively, as described in more detail later. These retainers 24, 26 are fixed to and cantilevered off of the left and right side edges 16, 18 of the case 10 and extend toward the opposite side, with the left retainers extending toward the right and the right retainers extending toward the left. Together, the front and rear walls 12, 14 define a thin, flat cavity between them. That cavity receives the flat portion or blade 50 of the trowel 40 (See FIGS. 6 and 7).

Figure 1A:
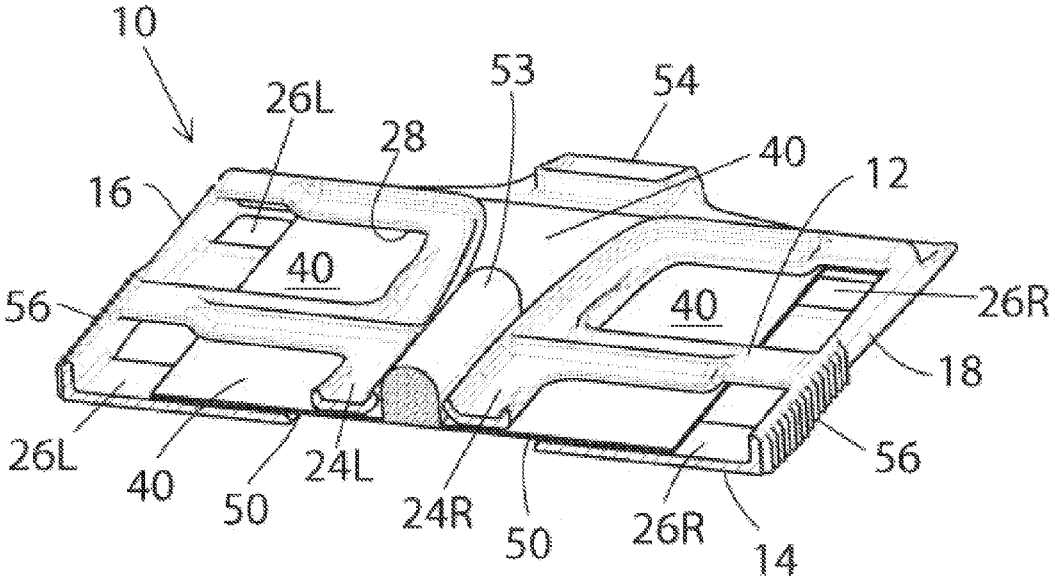
FIG. 1A is a section view along line 1A-1A of FIG. 1, but with a trowel housed in the case.
Figure 1B:
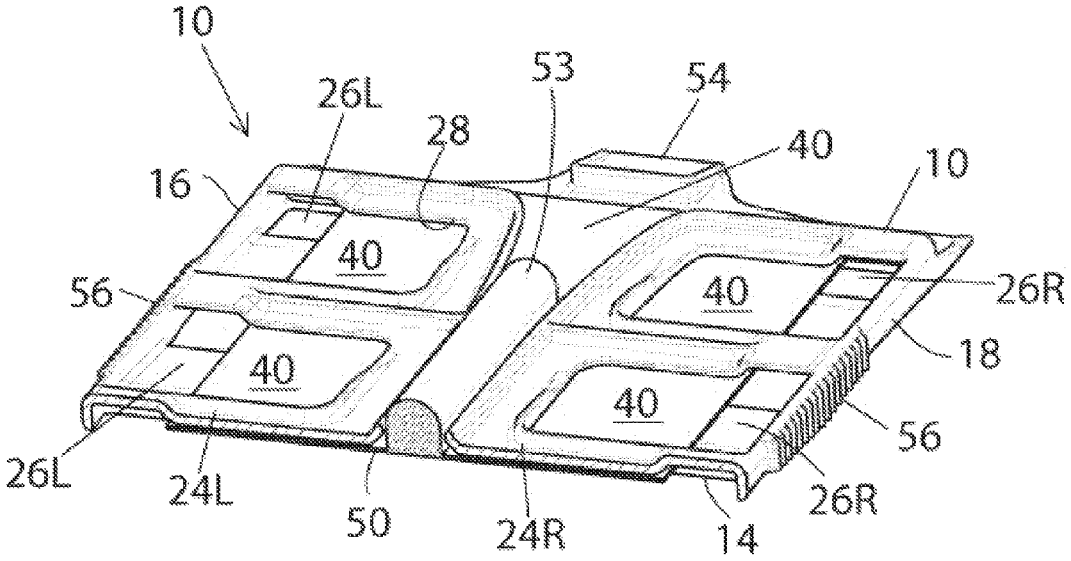
FIG. 1B is a section view along line 1B-1B of FIG. 1, but with a trowel housed in the case.

Each front retainer 24 (See FIGS. 1 and 1A) resembles a frame defining a substantially rectangular through opening 28, with the left side of the left front retainers 24L fixed to the left side edge 16 of the case 10 and the right side of the right front retainers 24R fixed to the right side edge 18 of the case 10. In this embodiment, the case 10 is symmetrical about an imaginary vertical, bisecting plane, so that, for every left front retainer 24L there is a corresponding right front retainer 24R. There is a gap between the left and right retainers adjacent the imaginary vertical, bisecting plane. On the front side, that gap defines an elongated, longitudinal, slotted opening 30 (See FIG. 1) that receives the beam 53 of the trowel handle 54. This slotted opening 30 extends substantially the length of the case 10 and tapers outwardly at the top end 32 to facilitate the insertion of the beam 53 of the trowel handle 52 into the opening 30, as explained in more detail later.

Another way to describe the front wall 12 is to say that it is made of left and right "ladders", or open grids, set side-by-side and separated from each other by a gap 30. Each ladder includes a plurality of rungs (the front retainers) 24 with a substantially rectangular through opening 28 between each adjacent pair of rungs 24. The left side ladder is fixed to the left side edge 16 of the case 10, and the right side ladder is fixed to the right side edge 18 of the case 10. The gap 30 is the elongated, longitudinal, slotted opening 30, which receives the beam 53 of the handle 52 of the trowel 40.

This embodiment is molded as a single piece, and the connection between the "ladders" and the edges 16, 18 of the case is thin enough to function as a live hinge, allowing the "ladders" to flex slightly relative to the edges 16, 18 of the case 10 to receive the thin, blade portion 50 of the trowel 40 and to provide a biasing force that presses against the flat face on the handle side of the blade 50 of the trowel 40, which presses the opposite face of the blade 50 against the rear retainers 26, to help hold the trowel 40 in place.

Figure 8:
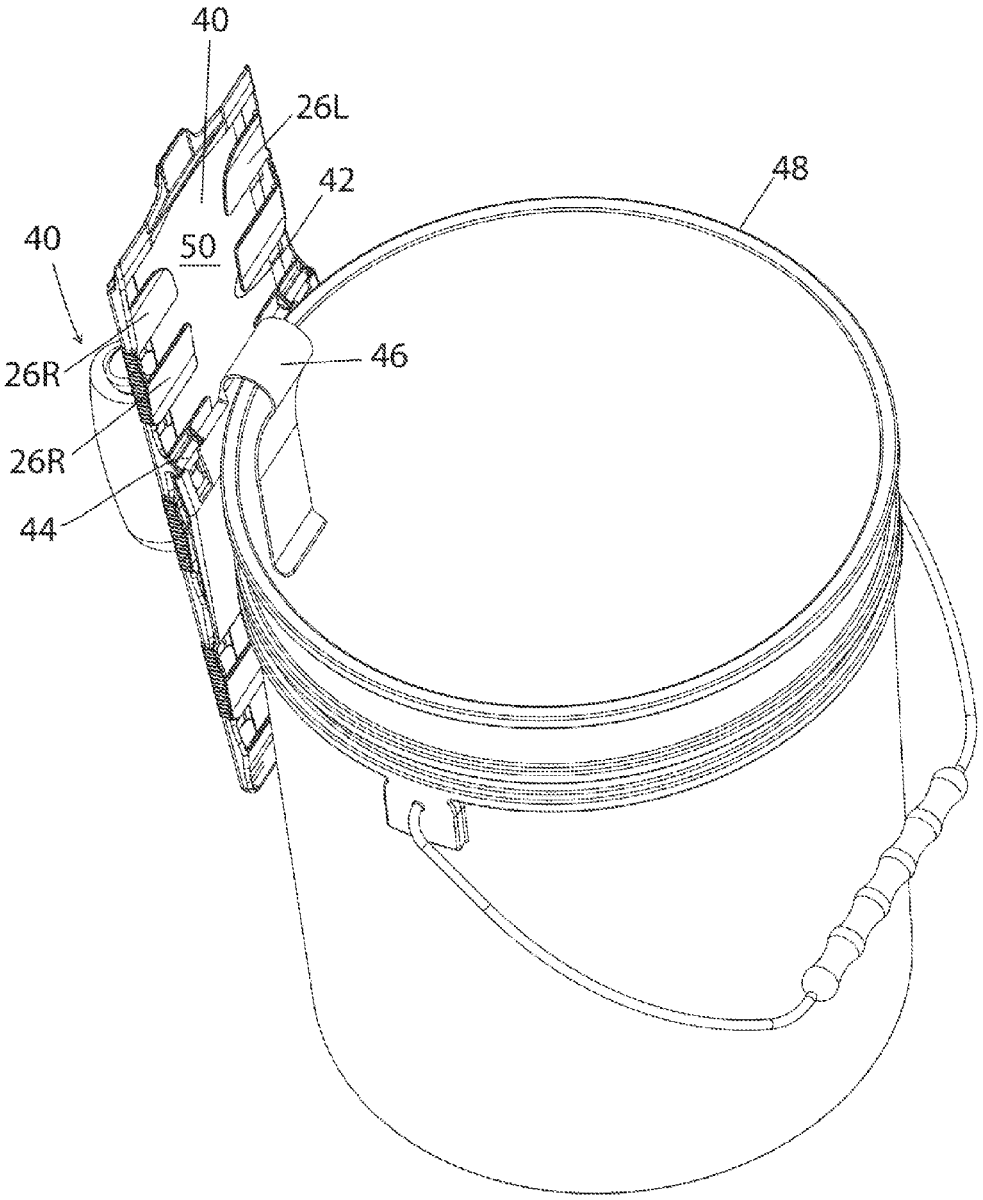
FIG. 8 is an opposite-end, perspective view of the case, trowel, and bucket of FIG. 7.

Referring to FIGS. 2 and 8, the rear wall 14 is made up of a plurality of rear retainers 26. Each rear retainer 26 is a substantially flat plate or tab projecting inwardly from its corresponding edge 16, 18 of the case 10. This is best appreciated in FIG. 8 wherein the trowel 40 hides the front wall 12 so that the rear retainers 26 are clearly visible and resemble individual fingers, which contact the rear face of the blade 50 of the trowel 40. The left side of each left rear retainer 26L is fixed to the left side edge 16 of the case 10 and the right side of each right rear retainer 26R is fixed to the right side edge 18 of the case 10. For every left rear retainer 26L there is a corresponding right rear retainer 26R, but these corresponding retainers 26L, 26R do not meet, leaving a relatively large gap 42 in between the left and right rear retainers.

As can be seen best in FIG. 2, the rear retainers 26 are aligned opposite the frame openings 28 in the corresponding front retainers 24 (or front ladder).

As shown in FIGS. 1 and 2, at the bottom 34 of the front retainer ladders there is a bridge 36, which connects together the lowermost left and right side front retainers 24L, 24R to close the bottom of the slotted opening 30. This bridge 36 provides structural integrity to the case 10 and provides a shoulder to stop the downward motion of the beam 53 of the handle 52 of the trowel 40. There is a second bridge 38 at the bottom edge 20 of the case 10, which is part of the rear wall 14 and which includes tabs 38A that wrap around the bottom edge of the trowel 40, extending from the plane of the rear wall 14 to the plane of the front wall 12. The blade portion 50 of the trowel 40 slides past the first bridge 36 (that is, the first bridge 36 only spans across the front wall 12 of the case 10), but is stopped by the tabs 38A of the second bridge 38 as described below.

The central portion of the second bridge 38 extends upwardly, in the same plane as the rear wall 14 and rear retainers 26 of the case 10. The tabs 38A provide protection for the user against contacting the sharp bottom edge of the blade 50 and provide a stop that prevents the blade portion 50 of the trowel 40 from moving downwardly below the second bridge 38. The second bridge 38 also provides structural integrity to the case 10. See FIGS. 6 and 7.

Figure 2B:
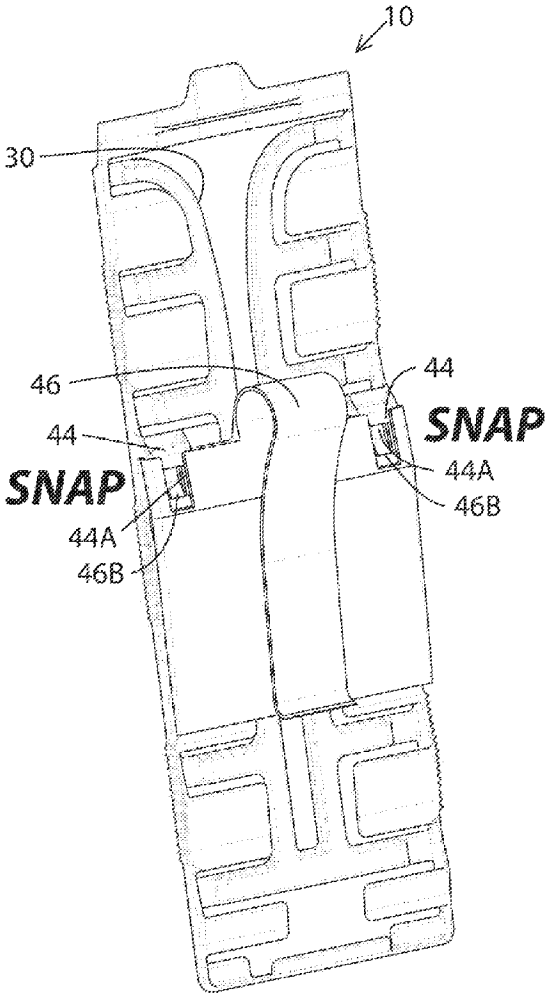
FIG. 2B is the same view as FIG. 2A, but showing the case with the mounting hook fully installed.
Figure 2A:
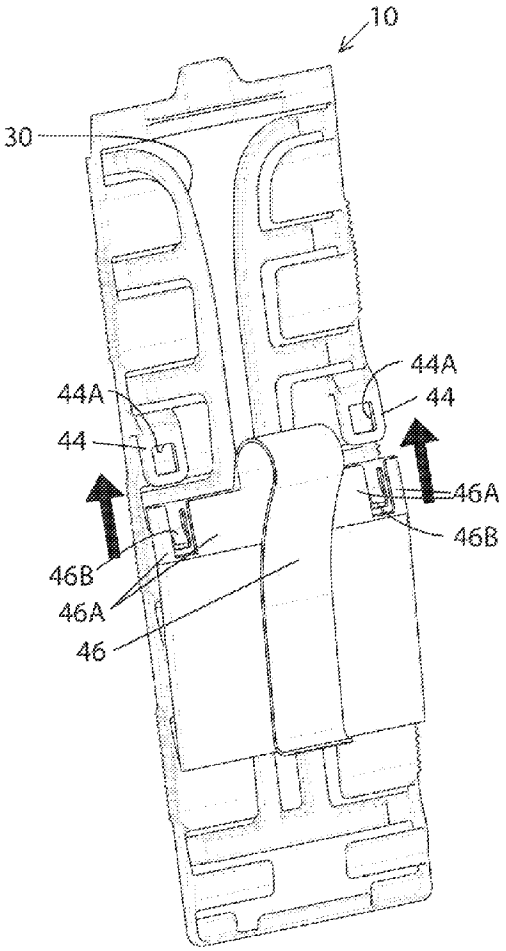
FIG. 2A is a rear perspective view of the case of FIG. 1, showing the mounting hook being installed on the case.
Figure 3:
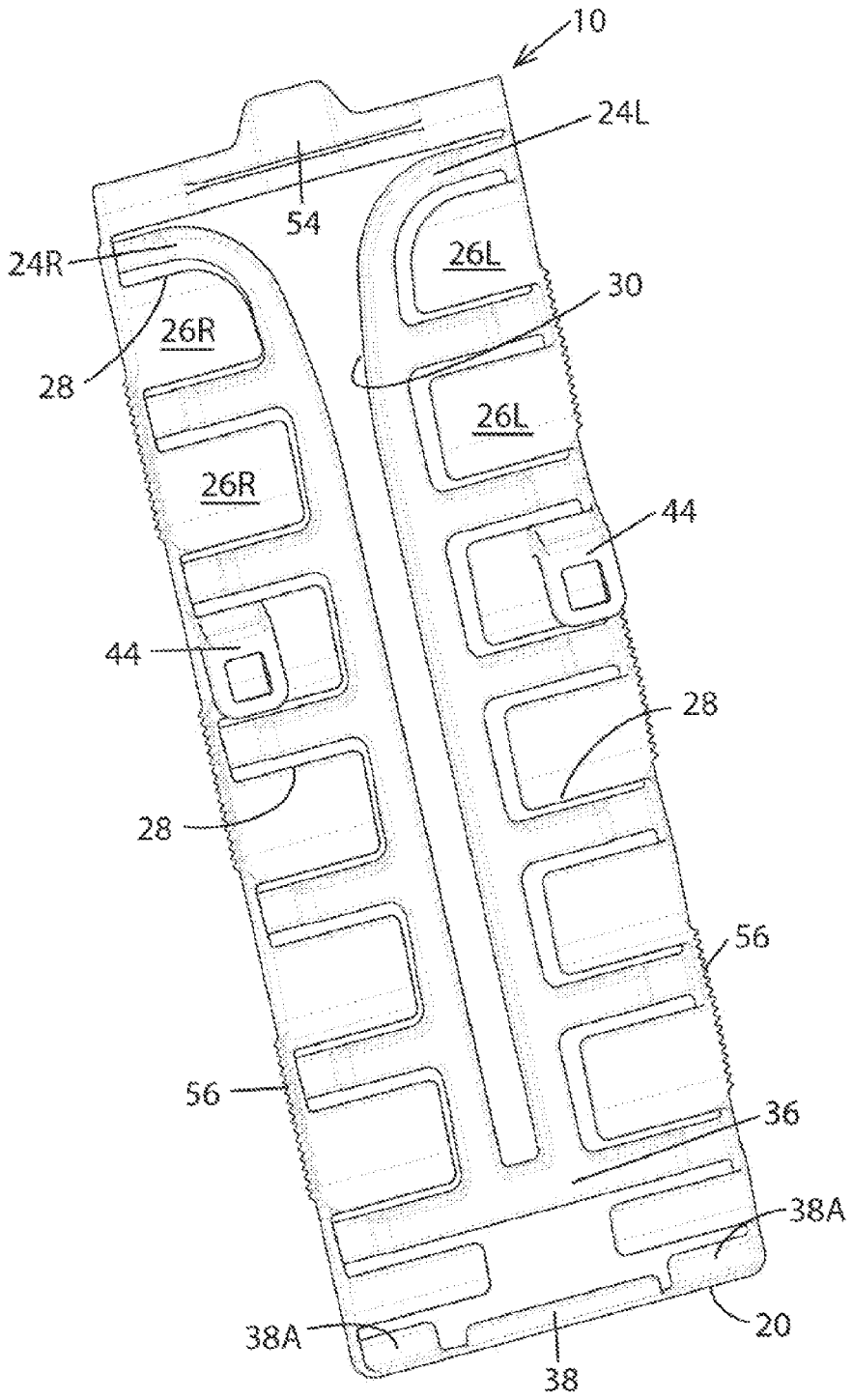
FIG. 3 is a rear perspective view of the case of FIGS. 1 and 2, with the mounting hook removed.

Referring to FIGS. 2A, 2B and 3, there are two projections 44 extending rearwardly from the rear wall 14 of the case 10. If the user wants to lay the encased trowel 40 down on the ground or on a table or other flat surface, the bottom edge 20 of the case 10 and these projections 44 will rest on the flat surface, keeping the trowel 40 and case 10 tilted at an angle to allow water to drain off the trowel and the case 10 (See FIG. 5).

These rearward projections 44 may also be used to secure a hook or clip 46 (See FIGS. 2A, 2B and 4) to the rear wall 14 of the case 10. The hook 46 snaps onto the rearward projections 44, as shown in FIGS. 2A and 2B. As shown in FIGS. 2A and 2B, the hook 46 defines two pairs of tracks 46A, which wrap around the sides of the projections 44, and two spring tabs 46B, which spring into the respective openings 44A in the projections 44 to lock the clip 46 onto the case 10.

Figure 7:
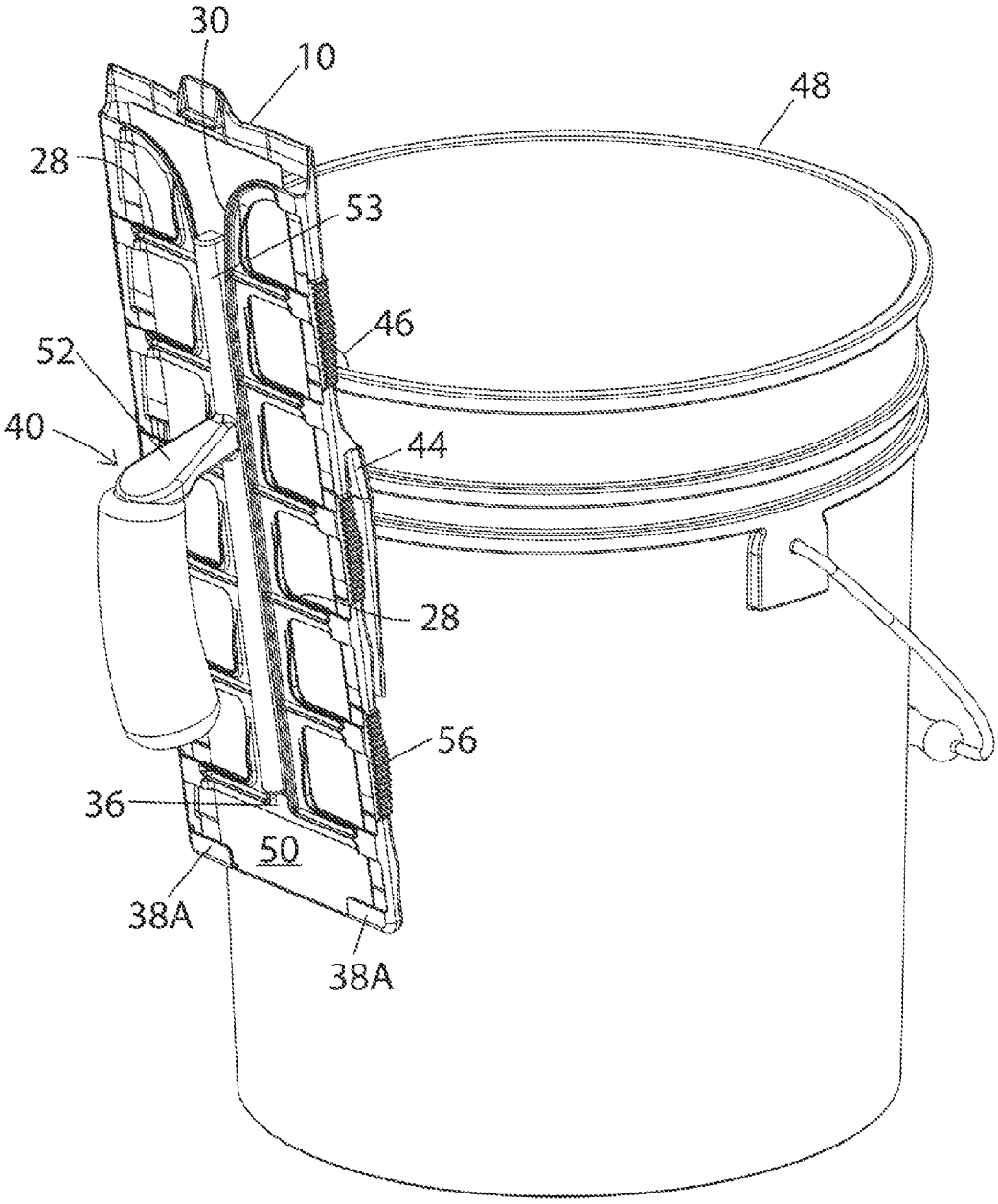
FIG. 7 is the same view as FIG. 6, with the trowel fully inserted into the case.

Once the clip 46 is installed, the user may use the clip 46 to mount the case 10 in a substantially vertical orientation, such as onto the rim of a bucket 48 (See FIGS. 6-8). The hook 46 also may be used to attach the case 10 to a belt or a back pocket worn by the user.

The hook 46 may be removed from the case 10 to allow for more compact storage by pressing the spring tabs and sliding the clip 46 downwardly, opposite to the direction in which it was installed.

Adjacent the top edge 22 of the case 10, a locking tab 54 (See FIGS. 1 and 4) with a ramped front surface projects forwardly from the rear wall 14. This locking tab 54 flexes rearwardly to allow the trowel 40 to slide into the slot between the front and rear walls 12, 14 and then, once the trowel 40 has passed downwardly past the locking tab 54, the locking tab 54 returns to its original position, which now is directly above the top edge of the blade portion 50 of the trowel 40. In this position, it presents a shoulder, which prevents the trowel blade 50 from accidentally sliding upwardly out of the top edge 22 of the case 10 (as may be appreciated in FIG. 7). In order to remove the trowel 40 from the case 10, the user manually flexes the locking tab 54 rearwardly, until it is to the rear of the plane of the trowel blade 50, and then slides the trowel 40 upwardly out of the case 10.

Several corrugations or teeth 56 are molded into the outer surface of the left and right side edges 16, 18 to provide a grip for the user to facilitate grabbing the case 10 while sheathing or unsheathing the trowel 40.

When the trowel 40 is inside the case 10, all the sharp edges of the blade 50 are recessed in from the edges of the case 10, which protects the user against contact with those sharp edges. The sides 16, 18 of the case enclose the sharp side edges of the trowel 40. The top edge of the trowel is recessed below the shoulder of the locking tab 54, and the bottom edge of the trowel is recessed upwardly, above the lower bridge 38. This is true for any shape of trowel, whether the blade portion of the trowel is rectangular, triangular, or has another shape.

As shown in FIGS. 6-8, the case 10 may be mounted onto the rim of a bucket 48 using the hook 46. Of course, this mounting arrangement may be used in a number of different applications, such as hooking onto the inside of the bucket, hooking onto the rear pocket or a belt of a user, hooking onto a piece of equipment, etc. The case 10 is preferably mounted in a substantially vertical orientation to promote draining of the case 10 and of the trowel 40 through the "open" structure of the case 10. The case 10 with the trowel 40 inside may be hosed off or dipped into a bucket of water to rinse off any material that may be adhering to the trowel.

As the trowel 40 is inserted into the case 10 (See FIG. 6) the user orients the trowel 40 so that the flat underside of the trowel 40 faces the rear wall 14 of the case 10, and the handle beam 53 and handle 52 project through and slide downwardly along the slotted opening 30 on the front wall 12 of the case 10. The tapered end 32 of the slotted opening 30, which has a wide top opening, facilitates the insertion of the beam 53 of the handle 52. The lower portion of the slotted opening 30 has a width that is just slightly larger than the width of the beam 53 of the handle 52, which helps keep the trowel 40 vertically oriented within the case 10.

The flat underside of the trowel blade 50 rides along the ramped surface of the locking tab 54, pushing the locking tab 54 rearwardly to enable the blade 50 to slide into the space between the front and rear walls 12, 14, until the leading edge of the trowel blade 50 is stopped by the bridge 38 along the bottom edge 20 of the rear wall 14 of the case 10, or until the leading edge of the beam 53 of the handle 52 of the trowel 40 is stopped by the bridge 36 along the bottom edge 34 of the front wall 12, as shown in FIG. 7.

When the trowel 40 is sheathed in the case 10, the flat blade portion 50 of the trowel 40 is fully encased inside the case 10, with all its sharp edges recessed inwardly from the edges of the case. This protects the blade 50 from being damaged and protects the user from being cut by the blade 50. The flat blade portion 50 of the trowel 40 fits tightly inside the case 10, with the handle 52 projecting out through the slotted opening 30. The user may grip the case 10 at its corrugations 56 while he pulls up on the handle 52 to unsheath the trowel 40 from the case 10.

When the trowel 40 is sheathed in the case 10, whether the handle of the trowel is put into the user's rear pocket or whether the clip 46 is used, the sharp edges of the trowel blade are all recessed and protected. This protects the trowel blade from damage and prevents the trowel blade from cutting someone. When the user wants to switch trowels, he easily can pull the new trowel out of its case 10 and put the trowel he has been using into the same or another case 10.

As may be appreciated, the case 10 may handle a large variety of sizes and shapes of trowels. The open configuration of the case 10 allows for easy rinsing of the case 10 and of the trowel 40 even when the trowel 40 is sheathed in the case 10.

It will be obvious to those skilled in the art that various modifications may be made to the embodiments described above without departing from the scope of the present invention as claimed.

What is claimed is:

1. A case for a trowel, comprising:

a generally planar front wall defining a central elongated, longitudinal slotted opening;

a generally planar rear wall parallel to the front wall; and left and right side edges, which connect said front and rear walls together to define a thin, flat cavity between the front and rear walls sized to receive and capture the flat blade portion of a trowel with a snug fit; wherein said front wall defines a plurality of through openings and said rear wall defines a plurality of individual retaining tabs lying opposite said through openings, each of said retaining tabs being connected to one of said side edges by means of a live hinge.

2. A case for a trowel as recited in claim 1, and further comprising a locking tab adjacent to said top edge, said locking tab being a part of said generally planar rear wall and having a top edge defining a ramp and a bottom edge defining a shoulder, wherein said locking tab may be flexed rearwardly for insertion of the trowel into the cavity and wherein, when said locking tab returns to its normal position, it lies directly above the cavity so that the shoulder provides a barrier that prevents the trowel from sliding out through the top of the cavity.

3. A case for a trowel as recited in claim 2, and further comprising a bridge at the bottom edge, which encloses the bottom edge of the cavity and provides a stop that prevents the trowel from sliding out the bottom of the cavity.

4. A case for a trowel as recited in claim 1, wherein at least one of said front and rear walls is hingedly connected to said left and right side edges via live hinges to aid said one of said front and rear walls in pressing the blade portion of a trowel against the other of said front and rear walls inside said cavity.

* * * * *